US006499722B1

(12) United States Patent
Kawasaki

(10) Patent No.: US 6,499,722 B1
(45) Date of Patent: Dec. 31, 2002

(54) SCREW JACK

(75) Inventor: Yasuji Kawasaki, Fujieda (JP)

(73) Assignee: Kawasaki Industrial Co., Ltd., Shizuoka (JP)

( * ) Notice: Subject to any disclaimer, the term of this patent is extended or adjusted under 35 U.S.C. 154(b) by 0 days.

(21) Appl. No.: 09/911,185

(22) Filed: Jul. 23, 2001

(51) Int. Cl.[7] ..... B66F 3/18
(52) U.S. Cl. ..... 254/103
(58) Field of Search ..... 254/103, DIG. 1, 254/DIG. 2, 425

(56) References Cited

U.S. PATENT DOCUMENTS 5,173,797 A * 12/1992 Zedekar et al. ..... 384/110
5,664,762 A * 9/1997 Rothbauer ..... 254/103
6,164,707 A * 12/2000 Ungchusrie et al. ..... 384/512

* cited by examiner

*Primary Examiner*—Robert C. Watson
(74) *Attorney, Agent, or Firm*—Darby & Darby

(57) ABSTRACT

The present invention relates to a screw jack that has a thin metal bearing for supporting a main screw shaft of a jack body to lift the jack body high as possible so that a torque increase can be kept to a minimum. For this purpose, the metal bearing is mounted and configured to have a substantially large outer diameter, and also a small stepped sliding-surface is formed on the top or bottom surface of the metal bearing.

12 Claims, 4 Drawing Sheets

PRIOR ART

Fig.3-a
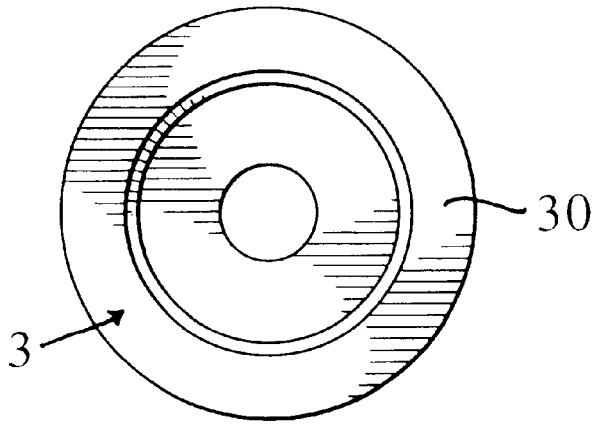
Fig.3-b
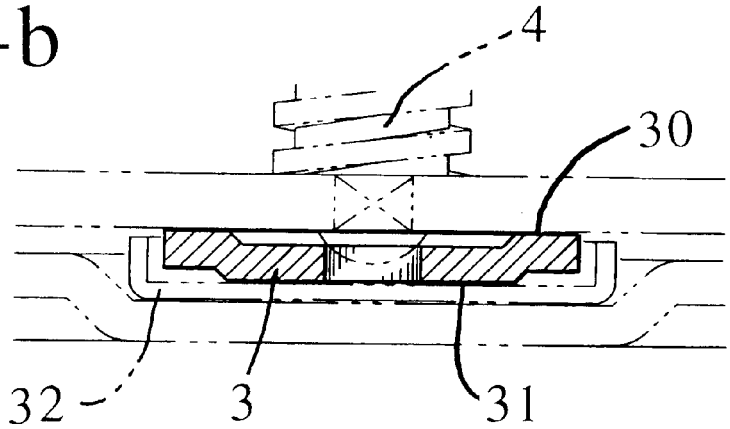
Fig.3-c
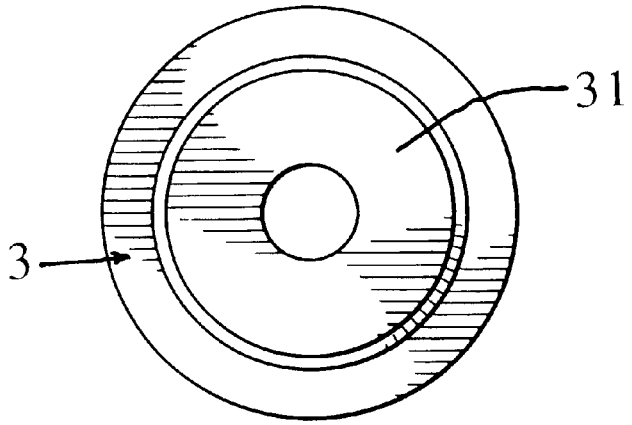

Fig.4-a
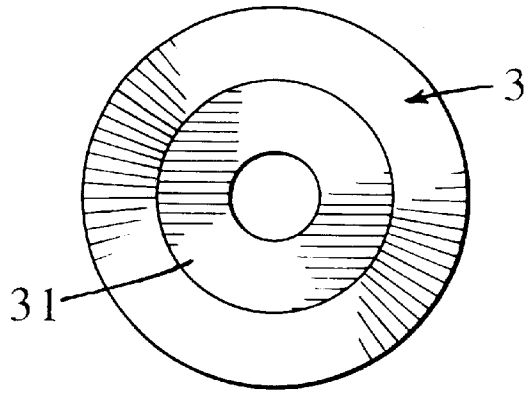
Fig.4-b
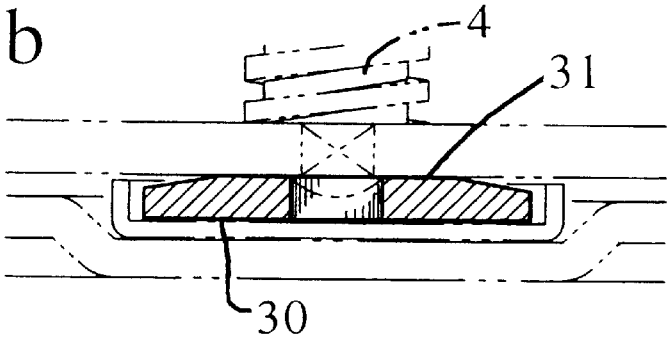
Fig.5-a
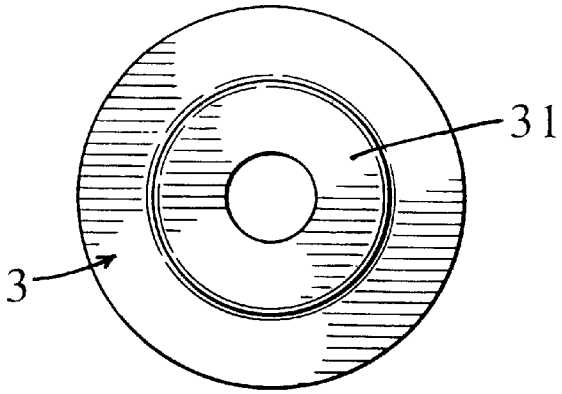
Fig.5-b
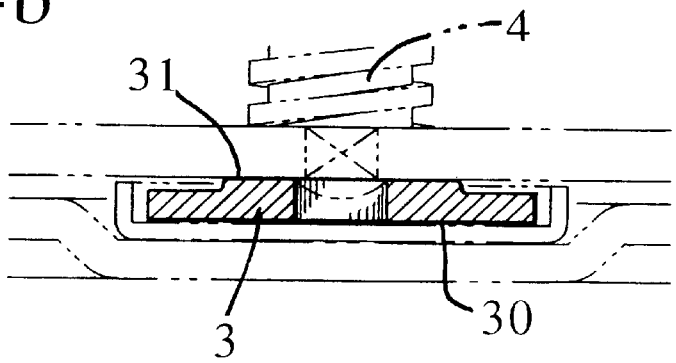

SCREW JACK

BACKGROUND OF THE INVENTION

1. Field of the Invention

This invention relates to a screw jack used for raising a structural object or a work piece, and more particularly to a screw jack that utilizes a screw.

2. Description of the Prior Art

The conventional automatic three-stage screw jack, as shown in FIG. 6, is structurally designed to equip a ball bearing C on a bed B at a lower end of an external cylinder A to receive and support a screw shaft D on the ball bearing C. Therefore, there is a disadvantage that the jack is able to raise an object only up to a level from which the thickness of the ball bearing has subtracted.

SUMMARY OF THE INVENTION

An object of the present invention is to provide a screw jack that is able raise an object up to a higher level in comparison with the conventional one.

According to the present invention, there is provided a screw jack that comprises a thin metal bearing arranged on a bottom surface of a jack body, where the thin metal bearing receives and supports a main screw shaft on the jack body. The thin metal bearing is constructed so as to have a large outer diameter while a stepped sliding-surface is constructed so as to have a small diameter and provided on the top or bottom surface of the large-diameter metal bearing.

BRIEF DESCRIPTION OF THE DRAWINGS

FIG. 3 is a set of a plan view FIG. 3-*a,* a vertical cross sectional view FIG. 3-*b* and a bottom view FIG. 3-*c* for illustrating an exemplified metal bearing to be installed on the screw jack of the present invention;

FIG. 4 is set of a plan view FIG. 4-*a* and a vertical cross sectional front view FIG. 4-*b* for illustrating another exemplified metal bearing to be installed on the screw jack of the present invention, FIG. 5 is a set of a plan view FIG. 5-*a* and a vertical cross sectional front view FIG. 5-*b* for illustrating still another exemplified metal bearing to be installed on the screw jack of the present invention.

DETAILED DESCRIPTION OF THE PREFERRED EMBODIMENTS

Figure 1:
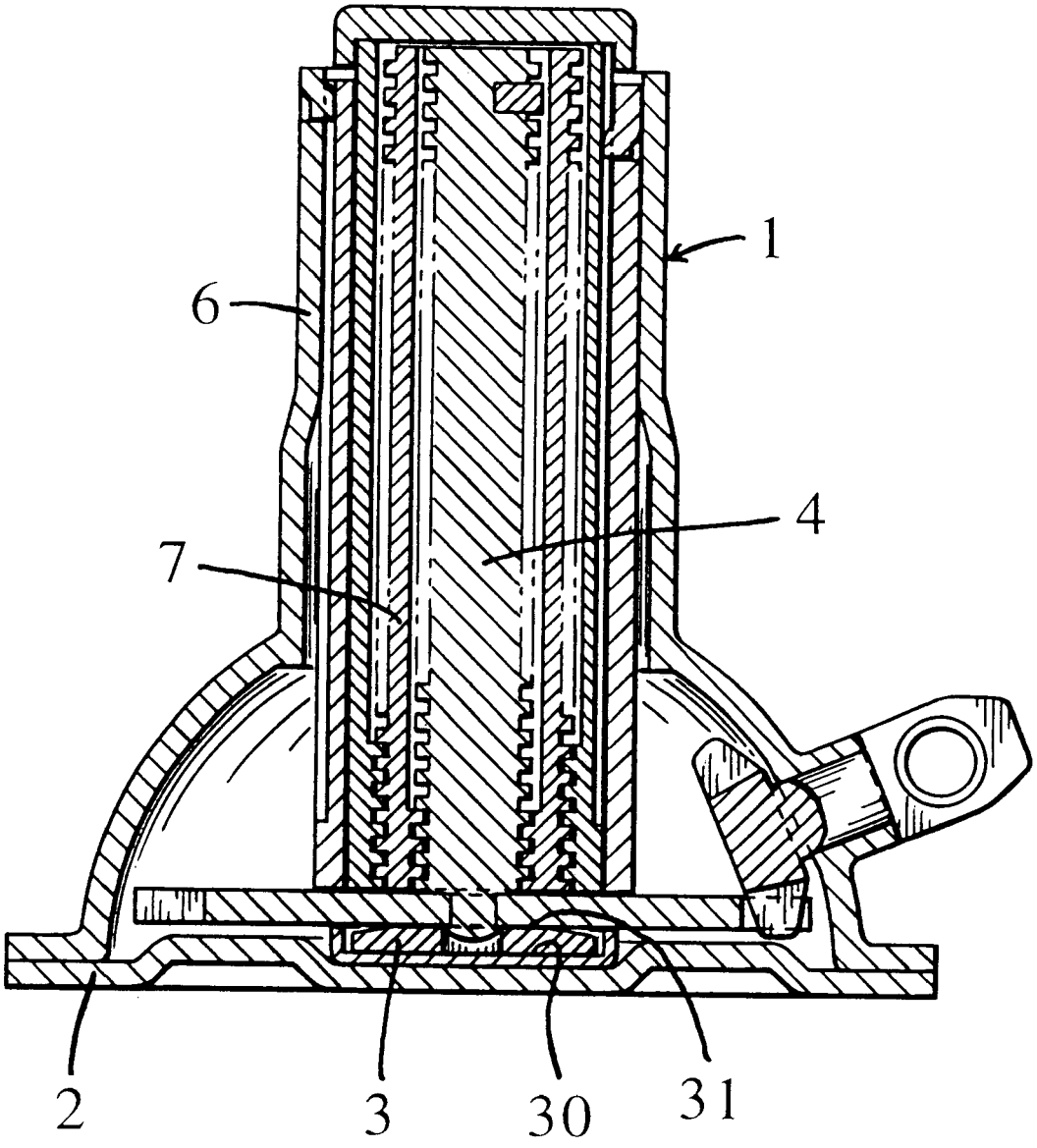
FIG. 1 is a vertical cross sectional front view of the screw jack in accordance with the present invention.
Figure 6:
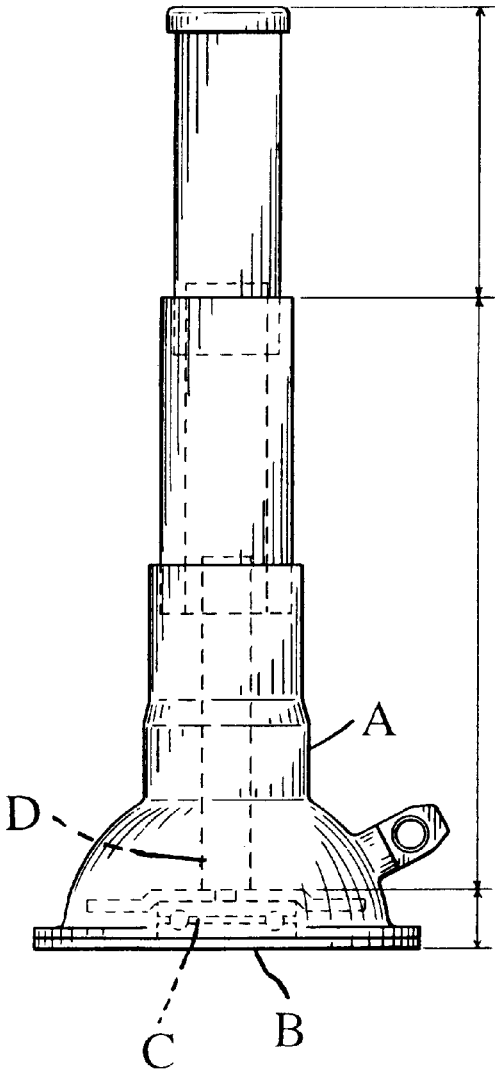
FIG. 6 is a front view of the conventional screw jack.
Figure 2:
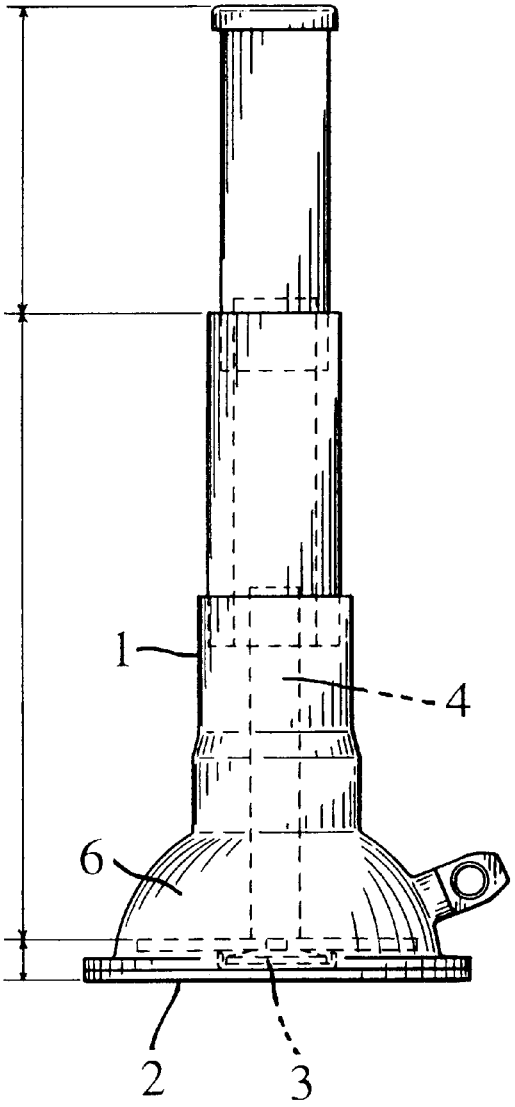
FIG. 2 is a front view that illustrates a condition in which the screw jack is being elevated high.

A screw jack as one of preferred embodiments of the present invention will be described with reference to FIGS. 1 to 5.

Reference numeral 1 denotes a jack body where a metal bearing 3 is installed on a bed 2 arranged on a lower end of the jack body and a main screw shaft 4 stands on the bed 2 by being received and supported by the metal bearing 3. The metal bearing 3 is structurally designed to have a substantially large outer diameter in comparison with the conventional one. In addition, a stepped sliding surface 31 is formed on the top or bottom surface of the metal bearing 31. The stepped sliding surface 31 is structurally designed to have a small turning-radius to relatively facilitate its sliding action for keeping a torque increase to a minimum. In the present invention, the outer diameter of the metal bearing is enlarged in the design in advance so that it may be easy to be materialized and it may be excellently stabilized. Thus, only the size of the sliding surface 31 is lessened to keep a torque increase to a minimum by facilitating its sliding action. Furthermore, reference numeral 6 denotes a case and 7 denotes an external cylinder.

According to the present invention, as described above, the thickness of the metal bearing is substantially smaller than that of the conventional ball bearing, so that the jack body is of a high level type, compared with the conventional one, resulting in excellent features of the jack. In addition, the metal bearing is structurally designed to have a large diameter in comparison with that of the conventional one, so that it ensures stability. Furthermore, a stepped sliding surface is formed on the top or bottom surface of the metal bearing and structurally designed to have a small turning-radius, so that its sliding action is facilitated and a torque increase can be kept to a minimum.

In FIGS. 3*a* and 3*b,* for example, a generally disc-shaped metal bearing 3 is located in a bearing cup 32 and has a stepped sliding surface 31 located on the bottom surface of the bearing 3. FIGS. 4*a* and 4*b* show a metal bearing wherein the stepped sliding surface 31 is located on the top surface of the bearing 3. FIGS. 5*a* and 5*b* show yet another metal bearing with the stepped sliding surface 31 on the bearing 3 top surface, but having a different stepped-contour than the bearing shown in FIGS. 4*a* and 4*b*.

What is claimed is:

1. A screw jack comprising:

a jack body;

a main screw shaft that stands on the jack body;

a bearing arranged on a bottom surface of the jack body, the bearing having a top surface and a bottom surface; and a stepped sliding surface formed on one of the top and bottom surface of the bearing, wherein the bearing receives and supports the main screw shaft on the jack body.

2. The screw jack of claim 1, wherein the stepped sliding surface has a smaller diameter than the bearing.

3. The screw jack of claim 1, wherein the bearing is slidable relative to the main screw shaft.

4. The screw jack of claim 1, wherein the bearing is a metal bearing.

5. A screw jack comprising:

a jack body;

a bearing supported by the jack body; and a main screw shaft supported by the bearing;

wherein the bearing has a top surface and a bottom surface and a stepped sliding surface on one of the top and bottom surfaces.

6. The screwjack of claim 5, wherein the stepped sliding surface has a smaller diameter than the bearing.

7. The screw jack of claim 5, wherein the bearing is slidable relative to the main screw shaft.

8. The screw jack of claim 5, wherein the bearing is a metal bearing.

9. A screw jack comprising:

a jack body;

a bearing cup supported by the jack body;

a bearing located in the bearing cup; and a main screw shaft supported by the bearing;

wherein the bearing has a top surface and a bottom surface and a stepped sliding surface on one of the top and bottom surfaces.

10. The screw jack of claim 9, wherein the bearing is slidable relative to the bearing cup and the main screw shaft.

11. The screw jack of claim 9, wherein the stepped sliding surface has a smaller diameter than the bearing.

12. The screw jack of claim 9, wherein the bearing is a metal bearing.

* * * * *